US006737967B2

(12) United States Patent
Farley

(10) Patent No.: US 6,737,967 B2
(45) Date of Patent: May 18, 2004

(54) WIRELESS WALK THROUGH TEST SYSTEM

(75) Inventor: Daniel G. Farley, Westminster, MA (US)

(73) Assignee: SimplexGrinnell, LP, Westminster, MA (US)

( * ) Notice: Subject to any disclaimer, the term of this patent is extended or adjusted under 35 U.S.C. 154(b) by 0 days.

(21) Appl. No.: 10/144,161

(22) Filed: May 10, 2002

(65) Prior Publication Data

US 2003/0210138 A1 Nov. 13, 2003

(51) Int. Cl.[7] ..... G08B 29/00
(52) U.S. Cl. ..... 340/514; 340/506; 340/516
(58) Field of Search ..... 340/500, 506, 340/514, 515, 516, 502, 503, 504, 505, 524, 531, 539.11, 539.13, 539.14

(56) References Cited

U.S. PATENT DOCUMENTS 4,141,007 A * 2/1979 Kavasilios et al. ..... 340/500
4,148,019 A * 4/1979 Durkee ..... 340/531
4,412,211 A 10/1983 Lautzenheiser et al. ..... 340/514
4,427,974 A 1/1984 Sheahan ..... 340/286.05
4,459,582 A 7/1984 Sheahan et al. ..... 340/539.16
4,538,138 A 8/1985 Harvey et al. ..... 340/521
4,652,859 A * 3/1987 Wienen ..... 340/503
4,725,818 A 2/1988 Motyka et al. ..... 340/514
5,686,885 A * 11/1997 Bergman ..... 340/514
6,313,744 B1 11/2001 Capowski et al. ..... 340/514
6,326,880 B1 * 12/2001 Tice ..... 340/514

* cited by examiner

*Primary Examiner*—Van Trieu
(74) *Attorney, Agent, or Firm*—Hamilton, Brook, Smith & Reynolds, P.C.

(57) ABSTRACT

The present invention provides a method and system of walk through testing a fire alarm system without disrupting the building occupants. A communications channel is setup between a control panel and a single human tester. The tester then triggers an alarm or trouble condition in a device. The control panel detects the address of the device and automatically returns to the tester, over the communications channel, a label indicating the location of the device.

29 Claims, 3 Drawing Sheets

WIRELESS WALK THROUGH TEST SYSTEM

BACKGROUND OF THE INVENTION

Typical building fire alarm systems include a number of fire detection devices located throughout a building. The devices include smoke detectors, heat sensors, pull stations and like devices. Normally, these devices are connected in loops and are monitored for alarm and trouble conditions at a central control panel. The loops are distributed throughout zones of an industrial plant, office or residential building.

Alarm and/or trouble indicators are located at the control panel to indicate in which zone the alarm and/or trouble condition is located. The alarm or trouble indicators may be LEDs and/or an alphanumeric display. A yellow LED usually indicates a trouble condition and a red LED usually indicates an alarm condition. A trouble condition may be caused by the removal of a device, faulty system wiring and the like. A tone alarm may be generated at the control panel to announce that a trouble condition has been detected. The tone alarm can be silenced by an operator authorized access to the control panel. During an alarm condition, audible devices are sounded throughout the zones of the building. These devices may include horns, bells and like devices. Light strobes may also be located throughout the building to provide a visual alarm.

A walk through test of each device verifies that each device is connected to the system in its assigned location. Before performing a walk through test, a human tester places the control panel in a test mode. When performing a walk through test, the tester places a device in an alarm or trouble condition. The control panel receives a signal from a sensing device identifying the location of the device and whether there is an alarm or trouble condition. The tester then must communicate with the control panel operator as to whether the alarm or trouble condition was properly detected by the control panel and whether the device is located in the proper zone. A communications channel is setup between the tester and a control panel operator. The communication channel may be setup through a pair of two-way radios, cellular phones or like devices. The control panel operator then resets the alarm or trouble condition at the control panel and the tester moves onto the next device to be tested.

A single tester walk through test such as presented in U.S. Pat. No. 4,725,818, allows the tester to place a device in an alarm or trouble condition. In test mode, the control panel senses the location of the device and whether there is an alarm or trouble condition. The control panel then audibly sounds a code, associated with the devices address, throughout the audible devices located in the system or zone. The tester listens to the code and verifies the location of the device by matching the code to a list of device addresses for all devices in the system. The control panel automatically resets the tripped device so the tester can move to the next device to test.

SUMMARY OF THE INVENTION

The single human tester method of verifying system installation and troubleshooting alarm devices can be very disruptive, not only to the tester but to the building occupants. This is especially important in buildings which do not typically have an unoccupied period during which testing can be preformed, such as hospitals. Also, only the device address is communicated to the tester and not the device location. Therefore, even though the system has the capability of conducting the verification with one tester, many tests are conducted with two people, a tester and control panel operator.

In accordance with the present invention there is provided a method and system of walk through testing a fire alarm system without disrupting the building occupants.

This result is achieved by setting up a private communications channel between the control panel and the tester. The tester then triggers a test condition in a device. The control panel detects the address of the device and automatically returns to the tester, over the communications channel, an indication of a location of the device. The indication may be a code associated with the device address which can be matched to location on a list. However, it is preferred that the indication be a direct identification of location such as presented in a label associated with the device address at the control panel.

The location of the devices may be a label which may be converted to a voice stream or textual message, which is transmitted to the tester over the communication channel. In response to the label, the tester can transmit over the communications channel, a response indicating the location of the device. The response may be stored in a storage device, and the response may be associated to the device tested. The response can be either a voice stream or textual message and the storage device may be a computer. The test condition may be an alarm or trouble condition.

An address of the device can also be returned to the tester. The tester transmits over the communications channel the response to the address of the device. The response is then stored in a storage device, and the response may be associated to the device tested. The response can be either a voice stream or textual message and the storage device may be a computer.

To setup a communications channel between the control panel and the tester, a computer may be connected to the control panel. A first communications device may be connected to the computer and a second communications device may be connected to the first communications device through a wireless connection. The communications device can be a two-way radio, cellular phone or pager interface.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not to scale, emphasis instead being placed upon illustrating the principles of the invention.

DETAILED DESCRIPTION OF THE INVENTION

Figure 1A:
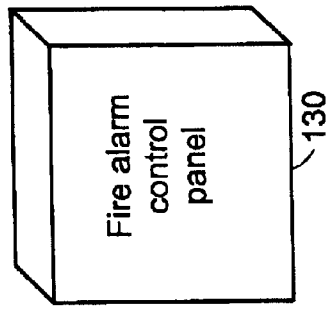
FIGS. 1 and 1A illustrate a fire alarm system showing a building's floor plan highlighting the zones of the fire alarm system.
Figure 1:
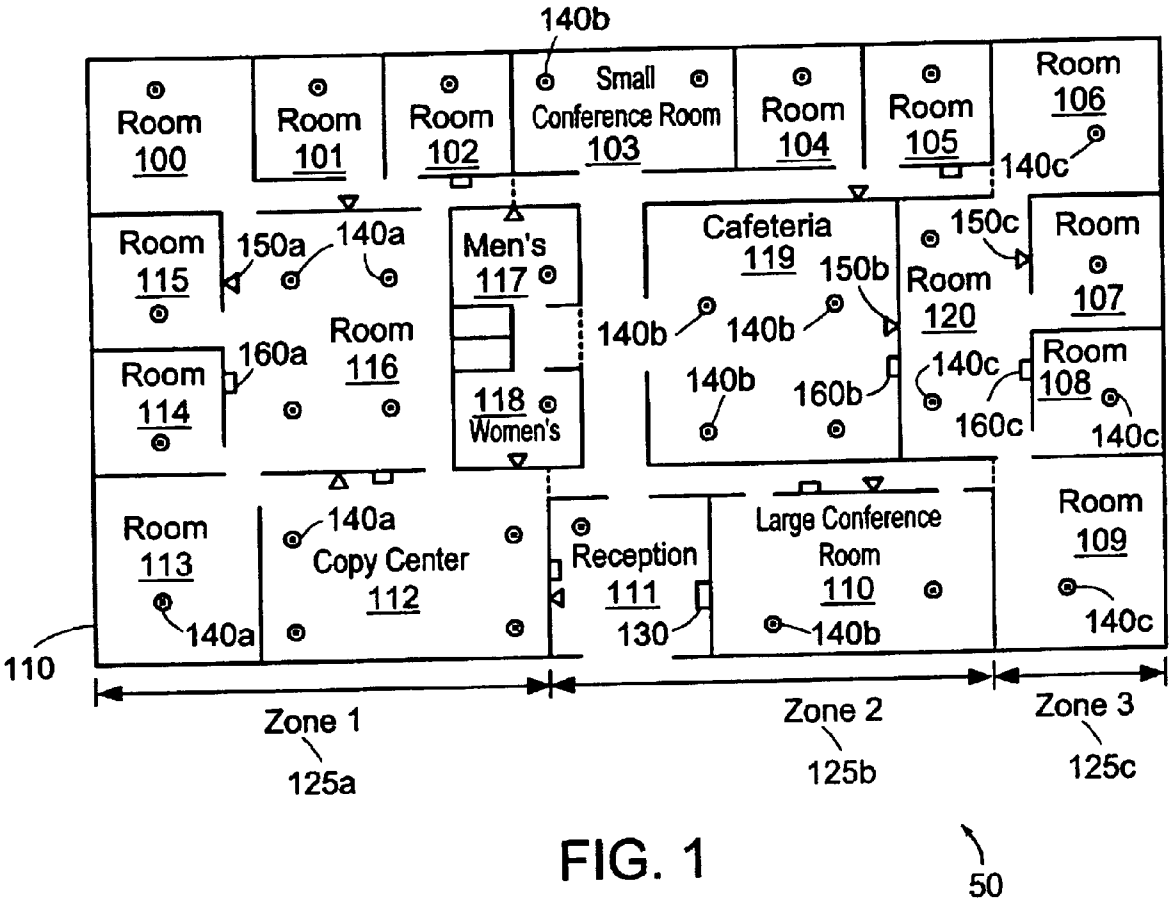

FIG. 1 shows a general layout of a building fire alarm system. Typically, fire alarm system 50 warns the buildings occupants and the local fire department of a potential fire emergency located within the building 110. The building 110 can be an industrial plant, office or residential building. The building 110 is divided into zones 125 to allow for accurate location of the fire emergency. As shown in FIG. 1, there are three zones 125*a*, 125*b* and 125*c*, respectively. However, it should be noted that there can be as many as N zones on M floors of the building 110 or multiple buildings. A central control panel 130 (also shown in FIG. 1A) monitors each zone for potential fire emergencies and trouble conditions.

Sensing devices 140, audio/visual devices 150 and pull stations 160 are strategically located within each zone 125 of the building 110 to provide for proper coverage. Sensing devices 140 are designated 140*a*, 140*b* and 140*c* for zones 125*a*, 125*b* and 125*c*, respectively. Audio/visual devices 150 are designated 150*a*, 150*b* and 150*c* for zones 125*a*, 125*b* and 125*c*, respectively. Pull stations 160 are designated 160*a*, 160*b* and 160*c* for zones 125*a*, 125*b* and 125*c*, respectively. The sensing devices 140 can be smoke, thermal detectors or like devices. The audio/visual devices 150 can be horns, bells, strobe lights or a combination thereof.

Figure 2A:
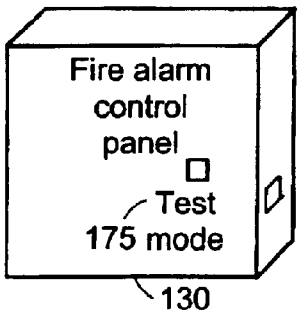
FIGS. 2 and 2A illustrate the fire alarm system of FIG. 1 being walk tested by a single tester without disturbing the buildings occupants.
Figure 2:
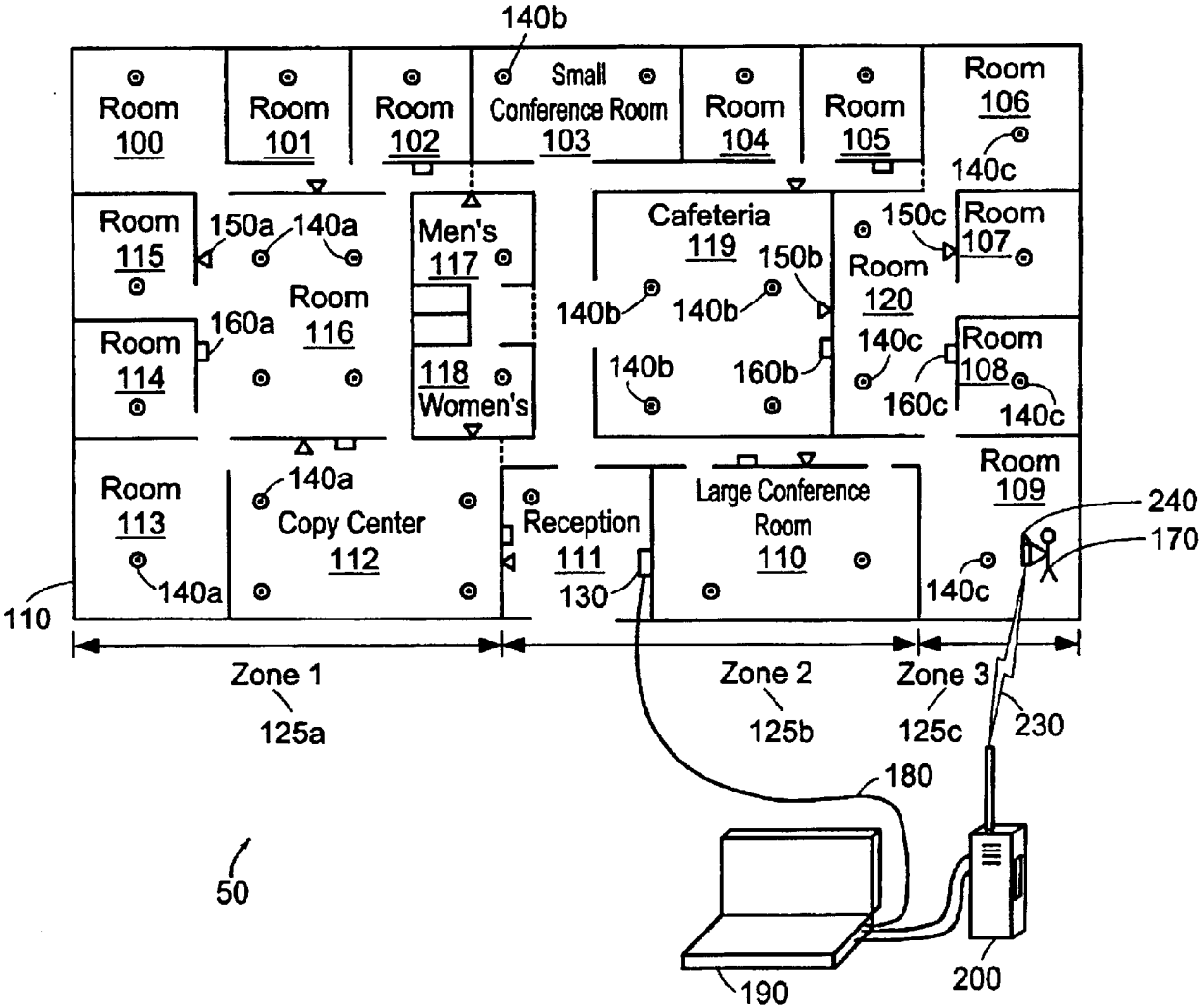

FIG. 2 shows a walk test being conducted by a single tester 170. Before starting the walk test of the alarm system 50, the tester 170 places the control panel 130 (also shown in FIG. 2A) in test mode 175 which disables all audio/visual devices 150 within the system 50. The tester 170 sets up a communications channel 230 between the tester 170 and the control panel 130. The tester 170 connects a computer 190 to the control panel 130 with a cable 180. The cable 180 can be an RS232, ethernet, serial, parallel or any other cable known in the art for connecting a computer 190 to the control panel 130. The computer 190 is connected to a two-way radio 200 through the audio-in, audio-out ports of the computer 190 and radio 200. In another embodiment, the tester 170 can connect a cellular phone or paging transmitter to the computer 190. The computer 190 can connect to a paging company in any way known in the art to send a textual message to the pager or cellular phone. The tester 170 establishes a communications link 230 via a pair of two-way radios, 200 and 240 by selecting the same radio frequency on respective radios 200, 240. The system is now ready to be tested.

The tester 170 places a device (sensing device 140*c*, located in room 109 of zone 125*c*) in an alarm or trouble condition, i.e., trips the device. The tester 170 can place the device in an alarm or trouble condition either by using smoke, magnets, activating (pulling) the pull station, physically removing the device or any other way known in the art. The control panel 130 detects the condition of the tripped device and sends a message to the computer 190 containing the location (room 109) and/or address of the tripped device (140*c*).

The computer 170 converts the message received from the control panel 130 to a voice stream and sends the voice stream to the tester 170 over the communications link 230 established between the radios 200 and 240. The tester 170 hears the location (room 109) and/or address of the tripped device (140*c*) and verifies if the device is wired correctly, i.e., located in the correct location and zone. In another embodiment, the computer 170 can send a textual message to the pager or an e-mail message to the cellular phone.

The tester 170 can relay a voice or textual message back to the computer 170 as to whether the device (140*c*) is wired correctly, i.e., located in the correct location and zone (room 109, zone 125*c*). The computer 170 stores the voice or textual message received from the tester 170 and associates it to the device tested (sensing device 140*c*, located in room 109 of zone 125*c*). The control panel 130 resets the system so the next device can be tested. The tester 170 moves to the next device until all devices in the alarm system 50 have been verified.

Figure 3A:
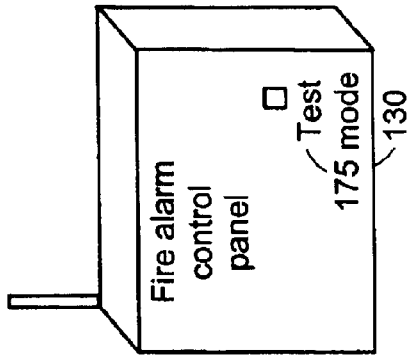
FIGS. 3 and 3A illustrate an alternative embodiment of the fire alarm system of FIG. 2.
Figure 3:
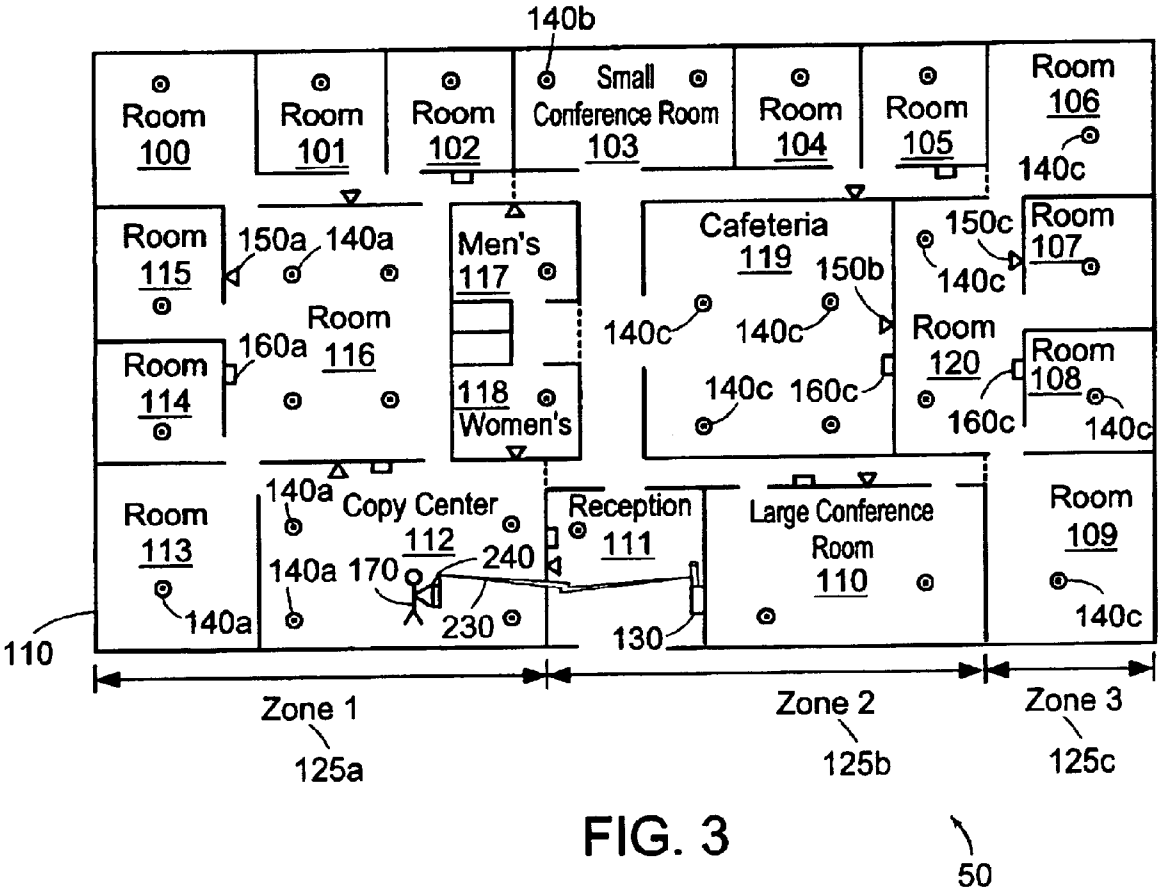

In another embodiment as shown in FIG. 3, the control panel 130 (also shown in FIG. 3A) can be made to incorporate the functions of the computer 190 and/or the radio 200, cellular phone or paging transmitter. If the computer 190 is incorporated into the control panel 130, the radio, cellular phone or paging transmitter can be connected to the control panel 130.

While this invention has been particularly shown and described with references to preferred embodiments thereof it will be understood by those skilled in the art that various changes in form and details may be made therein without departing from the scope of the invention encompassed by the appended claims.

What is claimed is:

1. A method of walk test in an alarm system, comprising the steps of:

setting up a private communications channel between a control panel and a tester;

triggering a test condition, by the tester, in a device;

at the control panel, detecting an address of the device; and automatically returning to the tester over the communications channel an indication of a location of the device.

2. A method as claimed in claim 1, wherein the indication is a direct identification of the location of the device.

3. A method as claimed in claim 2, wherein the direct identification is returned by:

converting a control panel label to a voice stream or textual message; and transmitting the voice stream or textual message to the tester over the communication channel.

4. A method as claimed in claim 3, which further includes:

the tester transmitting over the communications channel a response to the label indicating the location of the device;

storing the response in a storage device, and associating the response to the device tested.

5. A method as claimed in claim 4, wherein the response is either a voice stream or textual message.

6. A method as claimed in claim 4, wherein the storage device is a computer.

7. A method as claimed in claim 1, wherein the test condition is an alarm condition.

8. A method as claimed in claim 1, wherein the test condition is a trouble condition.

9. A method as claimed in claim 1, wherein the step of automatically returning to the tester over the communications channel the indication of the location of the device further includes returning an address of the device to the tester.

10. A method as claimed in claim 9, which further includes:

the tester transmitting over the communications channel a response to the address of the device;

a storage device for storing the response, and associating the response to the device tested.

11. A method as claimed in claim 10, wherein the response is either a voice stream or textual message.

12. A method as claimed in claim 10, wherein the storage device is a computer.

13. A method as claimed in claim 1, wherein the step of setting up a communications channel between the control panel and the tester includes:

connecting a computer with the control panel;

connecting a first communications device with the computer; and connecting a second communications device with the first communications device via a wireless connection.

14. A method as claimed in claim 13, wherein the communications device is a two-way radio, cellular phone, paging transmitter, or email connection.

15. A alarm system for walk test, comprising:

a plurality of alarm devices adapted to be triggered by a tester to activate a test condition;

a control panel;

a communications channel between the control panel and the tester;

an address of the device in the test condition being detected by the control panel, and an indication of a location of the device being automatically returned to the tester over the communications channel.

16. A alarm system as claimed in claim 15, wherein the indication is a direct identification of the location of the device.

17. A alarm system as claimed in claim 16, wherein a direct identification is returned by:

a voice stream or textual message converted from a control panel label; and a transmitter for transmitting the voice stream or textual message to the tester over the communication channel.

18. A alarm system as claimed in claim 17, which further includes:

a response to the label indicating the location of the device, transmitted by the tester over the communications channel;

a storage device for storing the response, and associating the response to the device tested.

19. A alarm system as claimed in claim 18, wherein the response is either a voice stream or textual message.

20. A alarm system as claimed in claim 18, wherein the storage device is a computer.

21. A method as claimed in claim 15, wherein the test condition is an alarm condition.

22. A method as claimed in claim 15, wherein the test condition is a trouble condition.

23. A alarm system as claimed in claim 15, wherein the indication of the location of the device further includes returning the address of the device to the tester.

24. A alarm system as claimed in claim 23, which further includes a storage device for storing a response transmitted by the tester over the communications channel, and associating the response to the device tested.

25. A alarm system as claimed in claim 23, wherein the response is either a voice stream or textual message.

26. A alarm system as claimed in claim 23, wherein the storage device is a computer.

27. A alarm system as claimed in claim 15, wherein the communications channel between a control panel and a tester includes:

a computer in connection with the control panel;

a first communications device in connection with the computer; and a second communications device in connection with the first communications device via a wireless connection.

28. A alarm system as claimed in claim 27, wherein the communications device is a two-way radio, cellular phone, paging transmitter, or email connection.

29. A alarm system for walk test, comprising:

means for setting up a communications channel between a control panel and a tester;

means for triggering an alarm or trouble condition in a device by the tester;

means for detecting an address of the device by the control panel; and means for automatically returning to the tester over the communications channel a label indicating the location of the device.

* * * * *